United States Patent [19]

Walker

[11] 4,017,104

[45] Apr. 12, 1977

[54] DOOR LATCH

[76] Inventor: Brooks Walker, 1280 Columbus Ave., San Francisco, Calif. 94133

[22] Filed: May 24, 1976

[21] Appl. No.: 689,092

[52] U.S. Cl. ..... 292/268; 292/259 R; 70/93

[51] Int. Cl.[2] ..... E05C 17/04

[58] Field of Search ..... 292/268, 259, 262, 263; 70/93

[56] References Cited

UNITED STATES PATENTS

| | | | |
|---|---|---|---|
| 924,277 | 6/1909 | Saphier | 292/259 |
| 1,524,088 | 1/1925 | Ernst | 292/269 |
| 1,596,183 | 8/1926 | Horlich, Jr. | 292/268 X |
| 1,673,189 | 6/1928 | Frank et al. | 292/268 |
| 2,683,049 | 7/1954 | Van Der Spek | 292/238 X |
| 3,458,226 | 7/1969 | Carlston | 292/268 |
| 3,690,709 | 9/1972 | Bogusz | 292/259 X |

*Primary Examiner*—Richard E. Moore
*Attorney, Agent, or Firm*—Gordon Wood

[57] ABSTRACT

A door latch for providing security in addition to that afforded by conventional key operated locks. A bar holds the door in its locked position and cooperates with a swingable plate for holding the door in a partially opened position.

9 Claims, 4 Drawing Figures

DOOR LATCH

This invention relates to a safety latch for holding a door in either a closed, locked position or a partially open position. When holding the door in closed position the bar provides additional security over that derived from the use of conventional door locks, latches, chains and the like. When holding the door in a partially open position it again provides security for the user and permits him to speak through the opening between the door and the frame without permitting the door to be swung past the partially open position.

The main object of the present invention is to provide a latch of the above described nature which is easily installed and which at the same time provides optimum security for the occupant of the house or apartment using the same.

Another object of the invention is the provision of a safety latch incorporating a holding bar which may be moved from a position holding the door closed to a position holding the door partially open and at the same time permit the door to be held against opening when the latch is between the closed and partially open positions without being unlocked between the two positions.

Another object of the invention is the provision of a safety latch which is extremely economical to make compared to prior art latches of like nature and which safety latch may be readily installed by the user.

Still another object of the invention is the provision of a latch having a keeper in the form of a hinge plate and which plate serves the purpose of holding the holding bar in door locking position and which also holds the door in partially open position.

Other objects and advantages will be apparent from the following specification and drawings.

Figure 1:
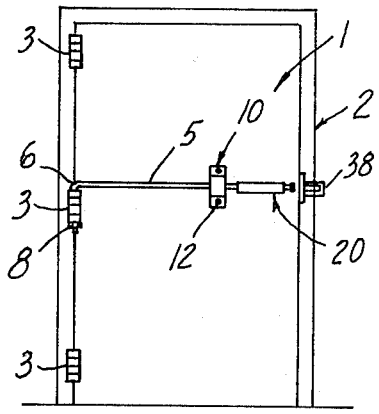
FIG. 1 is a side elevation of the interior side of a door structure showing the door and frame and the holding bar cooperating therewith.

Referring to FIG. 1 the invention is adapted to be used with a door generally designated 1 swingably mounted in a frame 2 by means of hinges 3. Extending horizontally across the door 1 is a holding rod generally designated 5 which may be formed at one end with a laterally offset portion 6. For the purpose of mounting the rod 5 at its left hand end the hinge pin of the central hinge 3 may be removed so that said offset portion 6 can be received through the hinge knuckles and secured thereto by means of nut 8. The right hand end of rod 5 is supported by means of a support 10 which receives rod 5 therethrough and which support is secured to the door 1 by means of a pair of screws 12.

Figure 2:
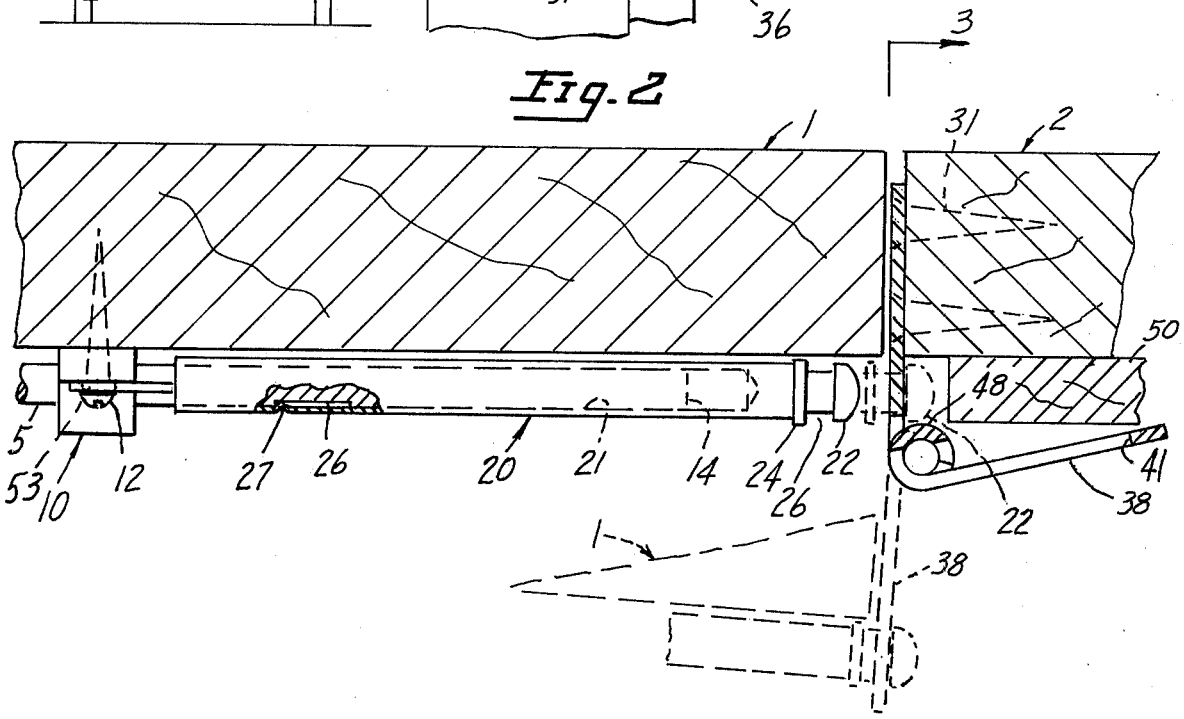
FIG. 2 is a greatly enlarged horizontal cross section of the door and frame taken at the latch edge of the door and showing the invention. The section is taken in a plane indicated by lines 2—2 of FIG. 3 but with the swinging plate in door locking position.

Referring to FIG. 2 the right hand end of rod 5 is indicated at 14. Slidably received over said right hand end of rod 5 is a bar generally designated 20 which is provided with a longitudinally extending bore 21 through the open end of which the rod 5 is inserted so that said bar 20 is slidably received on said rod. The rod

20 is provided at its outer end with an enlarged head 22 and spaced inwardly from said head is an enlarged annular portion 24 thereby defining an annular groove 26 between said head and said enlarged portion 24. The bar 20 is adapted to slide on rod 5 so as to be movable from a retracted position shown in full line in FIG. 2 to a projected position shown in dotted lines.

In order to restrict movement of the bar 20 to the retracted and projected positions the rod 5 may be provided with an elongated flat 26 and a projection 27 may be struck out of the material of bar 20 to enter the space formed by flat 26 and thus restrict movement of the bar 20 along the length of rod 5 to prevent accidental removal.

Figure 3:
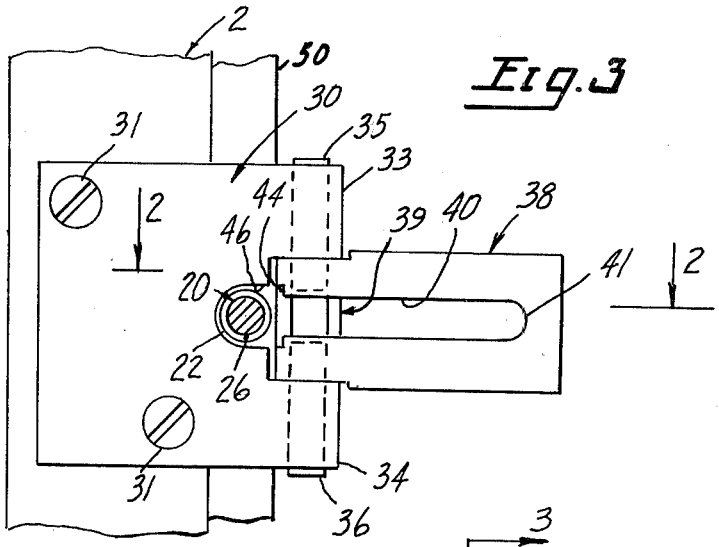
FIG. 3 is an elevation of the inner side of the door frame showing the swingable plate and the supporting means therefor.

Referring to FIG. 3 a hinge plate generally designated 30 is secured to the inner face of frame 2 by means of screws 31. Said plate 30 is formed at its outer edge with a pair of upper and lower knuckles 33, 34 in which are fixedly secured upper and lower hinge pins 35, 36. Swingably secured on the inner ends of hinge pins 35, 36 is a plate 38 which is formed at its inner end with a hinge knuckle 39 the upper and lower portions of which receive the inner ends of hinge pins 35, 36 therein. The plate 38 is formed with an elongated slot 40 with the inner end 41 of said slot being closely adjacent the outer end of plate 38. The slot 40 extends through the hinge knuckle 39 so that the reduced diameter groove 26 of sliding bar 20 may be received in said slot and travel along the length of the same to abut the inner end 41 thereof.

Figure 4:
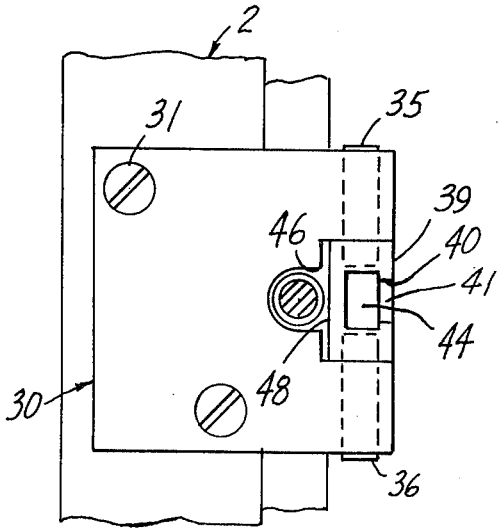
FIG. 4 is a view similar to FIG. 3 but with the swingable plate at right angles to the FIG. 3 position.

As best seen in FIG. 4 the hinge knuckle 39 of plate 38 is formed with an enlarged opening 44 which communicates with slot 40. The enlarged opening 40 is adapted to receive therethrough the enlarged head 22 of sliding bar 20.

The hinge plate 30 is recessed as shown at 46 in FIGS. 3, 4 in order to receive therethrough the enlarged head 22 of sliding bar 20. Thus when the sliding bar 20 is projected to its dotted line position of FIG. 2 it is received through the opening 46 as best seen in FIGS. 3, 4. When it is desired to hold the door 1 in locked position the swinging plate 38 is swung toward frame 2 to the full line position of FIG. 2 so that the portion 48 of hinge knuckle 39 acts as an abutment for head 22 of bar 20 so as to prevent opening movement of the door 1. If it is desired to permit partial opening of the door 1 the swingable plate 38 is swung to the dotted line position of FIG. 2 so that, with the sliding bar 20 projected, the head 22 thereof is permitted to pass through the opening 44 formed in knuckle 39 thus permitting the bar 20 to move along the length of plate 38 with the annular groove portion 26 received within slot 40. The door 1 is shown in dotted lines in its partially open position in FIG. 2 and it will be noted that the bar 20 in said partially open position engages the inner end 41 of slot 40.

From the above described structure it will be seen that if it is desired not to use the additional security of the bar 20 the same does not interfere with the normal use of the door when it is in the retracted position of FIG. 2 and when the swingable plate 38 is in its inoperative position against frame 2 shown in dot-dash lines in FIG. 2. Also the bar is not likely to catch on clothing of the user. However, if it is desired to hold the door against opening movement from its locked position it is merely necessary to project the bar 20 to its projected dotted line position in FIG. 2 in which position the portion 48 of knuckle 39 prevents opening movement of the door. When it is desired to open the door from its closed position to a partially open position it is merely necessary to swing plate 38 to about the dotted line position of FIG. 2 at which position it will prevent further opening movement beyond the predetermined partially open position.

If the frame 2 includes a molding 50 the latter may be cut away as shown in FIG. 2 to accommodate head 22 of bar 20.

To prevent retraction of the bar 20 from outside the door by means of a thin picking tool a detent 52 may be swingably supported on a spacer 53 interposed between the head of upper screw 12 and the support 10 to permit the detent to be swung from an upper inoperative position to a position with its outer end engaging the left hand end of bar 20.

I claim:

1. In a door structure that includes a frame, and a door having a hinge edge and an opposite latch edge, a safety latch comprising:

a bar slidably supported on said door for horizontal movement from a retracted position alongside said door and inwardly of said latch edge to a projected position with one end extending past said latch edge, a plate swingably mounted on said frame for movement between a first position alongside said frame and substantially parallel to the plane of said door to a second position substantially at right angles to the plane of said door, said plate being formed with an abutment adapted to be engaged by the outer end of said bar when the latter is in said projected position and said plate is in said first position with the door closed to prevent opening movement of said door, said plate being further provided with an elongated slot closed at its inner end and into which the outer end of said bar may be received when the latter is in said projected position and said plate is in said second position to permit said door to be partially opened with the outer end of said bar against the inner end of said slot and to prevent further opening from said partially open position.

2. A safety latch according to claim 1 wherein a hinge pin is secured to said frame, and said plate is provided with a hinge knuckle rotatably supported on said hinge pin, said slot extending through said knuckle from one side of the axis of said knuckle to the opposite side thereof.

3. A safety latch according to claim 2 wherein said abutment is the portion of said knuckle diametrically opposite said slot.

4. A safety latch according to claim 1 wherein said bar is provided with an enlarged head at said one end of a larger lateral extent than the width of said slot to prevent removal of said bar from said slot when said bar is in said slot and the door is in said partially open position.

5. A safety latch according to claim 4 wherein said knuckle is formed with an enlarged opening at the outer end of said slot to receive said head therethrough when said plate is in said second position.

6. A safety latch according to claim 2 wherein said hinge pin is carried by a hinge plate fixedly secured to said frame at said latch edge, said hinge plate being provided with an opening to receive said one end of said pin therethrough when said bar is in its projected position with said door closed and with said one end of said bar alongside said abutment.

7. A safety latch according to claim 6 wherein said hinge plate is coplanar with said first mentioned plate when the latter is in said second position.

8. A safety latch according to claim 6 wherein said opening is sufficiently large to receive said head of said bar therethrough when said bar is in its projected position.

9. A safety latch according to claim 1 wherein a detent is provided engageable with said bar to prevent retraction of said bar from said projected position.

* * * * *